US006602128B1

(12) United States Patent
Spengler

(10) Patent No.: US 6,602,128 B1
(45) Date of Patent: Aug. 5, 2003

(54) CLEAN AIR ROOM WITH A BLOWER INCLUDING A HEPA FILTER AND DUCTS

(76) Inventor: Charles W. Spengler, 3024 W. Prospect Rd., Fort Collins, CO (US) 80526

( * ) Notice: Subject to any disclaimer, the term of this patent is extended or adjusted under 35 U.S.C. 154(b) by 0 days.

(21) Appl. No.: 10/153,722

(22) Filed: May 24, 2002

(51) Int. Cl.[7] ..... B01L 1/04
(52) U.S. Cl. ..... 454/187; 454/306
(58) Field of Search ..... 454/187, 284, 454/292, 296, 297, 306, 333

(56) References Cited

U.S. PATENT DOCUMENTS

| | | | | | |
|---|---|---|---|---|---|
| 673,393 | A | * | 5/1901 | Gans | 239/225.1 |
| 1,597,588 | A | * | 8/1926 | Fairbanks | 454/280 |
| 3,363,532 | A | * | 1/1968 | Horneff | 454/187 |
| 3,505,989 | A | * | 4/1970 | Truhan | 219/400 |
| 3,899,823 | A | * | 8/1975 | Lambert | 29/890.141 |
| 4,250,800 | A | * | 2/1981 | Brockmeyer | 285/354 |
| 4,531,956 | A | * | 7/1985 | Howorth | 454/187 |
| 4,706,551 | A | * | 11/1987 | Schofield | 135/117 |
| 5,725,426 | A | * | 3/1998 | Alvarez | 135/90 |
| 6,095,917 | A | * | 8/2000 | Utsuki | 454/187 |
| 6,117,005 | A | * | 9/2000 | Weiss | 454/202 |
| 6,119,689 | A | * | 9/2000 | Korman | 128/205.12 |
| 6,280,320 | B1 | * | 8/2001 | Paschke et al. | 454/296 |
| 6,368,208 | B1 | * | 4/2002 | Minoshima | 414/435 |

* cited by examiner

*Primary Examiner*—Derek S. Boles
(74) *Attorney, Agent, or Firm*—Ronald E. Greigg

(57) ABSTRACT

A system which easily changes a positive pressure space to a negative pressure space or vice versa. The system includes at least one space divider which forms first and second closed spaces. A blower, and blower duct combination in the first space is connected with one end of an airflow duct in the second space to force air into the second space to create a positive pressure in the second space. For creating a negative pressure in the second space, the blower, blower duct is placed in the second space and an outlet end of the blower duct is connected to another end of the flow duct in the second space to force air from the second space to produce a negative pressure in the second space. The flow duct is provided with apertures in a bottom surface through which air is forced into the second space when a positive pressure space is created. A rolled up flexible sheet is secured at one end of the flow duct to cover apertures in the bottom surface of the flow duct when the blower, and blower duct is connected to the flow duct to create a negative pressure in the second space.

18 Claims, 5 Drawing Sheets

A CLEAN AIR ROOM WITH A BLOWER INCLUDING A HEPA FILTER AND DUCTS

CLEAN AIR ROOM WITH A BLOWER INCLUDING A HEPA FILTER AND DUCTS

BACKGROUND OF THE INVENTION

1. Field of the Invention

This invention relates to clean rooms of the type used in research projects involving laboratory animals or the like and usually employ a blower, filter, and ducts to supply air under positive pressure to an area, or to create a negative pressure in the area, e.g. by exhausting filtered air out of the area.

2. Description of the Prior Art

A typical application for a clean room application of the type with which this invention is concerned would be in a life science laboratory where lab animal colonies are housed. Multiple colonies (groups/herds) are commonly housed in a building with multiple clean rooms. In most cases researchers are trying to keep these colonies disease free, in which the clean room with the positive pressure controlled space would house the colony. But, if the colony did contract a disease, or if the colony of animals under study were purposely diseased, the researchers could reverse the design, with the diseased colony now being in the negative pressure controlled space. This reversal of pressure could be done very quickly with the present invention. The industry has developed a new term of art to define this ability to reverse the pressure space as needed: Inclusion/Exclusion.

Some of the many patents which have been issued for the design of clean air rooms and equipment therefor include: U.S. Pat. Nos. 3,824,909; 4,531,956; 4,804,392; 4,929,262; 5,312,465; 5,645,480; and 6,080,060. These patents are cited to illustrate different systems for providing a clean air room. The applicant's U.S. Pat. No. 4,804,392 is typical of structures defined by vinyl walls over a framework, which structure allows for air feed into or removal from a clean room. Applicant's U.S. Pat. No. 5,645,480 shows a later design wherein the filter-blower is mounted on a separate frame for easier detachment from the clean room and movement. Quite often these so-called portable clean room structures are used in older buildings to obtain and maintain clean areas without the trouble and expense of major renovation to the building spaces themselves.

SUMMARY OF THE INVENTION

This invention is directed to a clean air room which has at least one quickly installed divider wall for providing the clean room selectively with a positive or negative pressure. In an arrangement with two dividers within the clean room, separate spaces, one for positive pressure and the other for negative pressure, could be defined. The system includes at least one HEPA filter in combination with at least one blower and suitable ducts through which air flow is directed into or from the clean air room or separate spaces defined within it. One of these separate spaces could be set up between the divider wall and an entrance door into the clean room as an airlock for researchers entering or exisiting the clean room.

It is therefore an object of the invention to provide a clean air room having at least one quickly installed room divider.

Another object is to provide ducts for directing clean air into the room or air out of the room.

Yet another object is to provide a quick and easy way to convert a duct from directing air into a room to create a positive pressure environment or directing air from the room to create negative pressure environment.

These and other features and advantages of the present invention will become clear from an understanding of the following disclosure including the drawings.

DETAILED DESCRIPTION OF THE INVENTION

Figure 1:
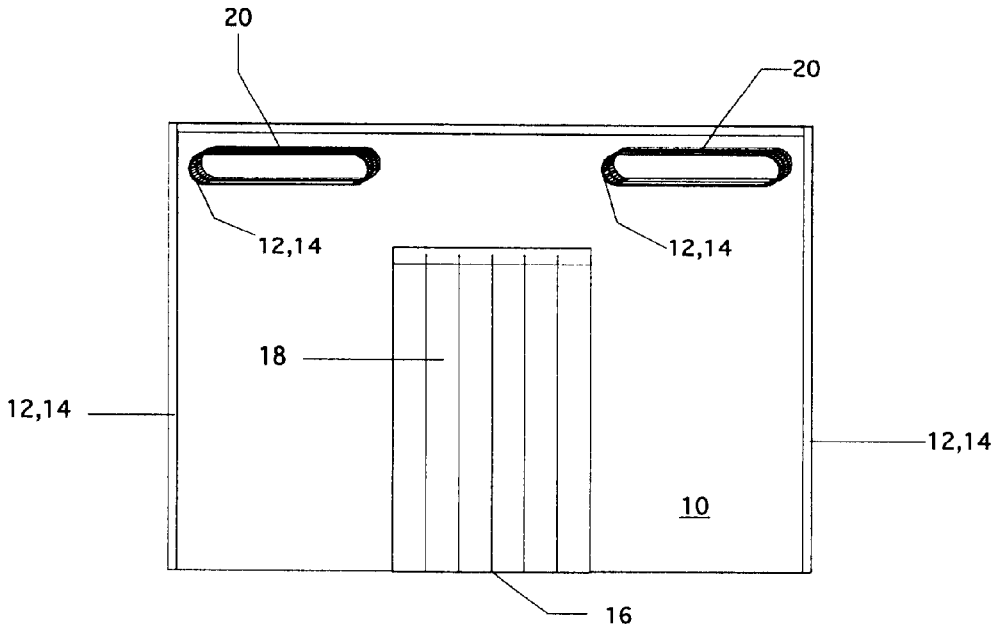
FIG. 1 illustrates a removable wall which separates a positive pressure space from a negative pressure space.

Now referring to the drawings wherein each reference character refers to a like part throughout the several views, FIG. 1 illustrates a divider 10 made of vinyl or any other desired material and having outer top and side surfaces provided with hooks 12 and loops 14 which match with loops 14 or hooks 12 on the inner top and side surfaces of the room. Such connections are known generically as hook and loop fasteners, one commonly used brand of which is VELCRO®. The divider is provided with a door 16 having matching strips 18 made of the same or different material from that of the divider. The door 16 is configured such that very little air leaks by the different sections. The divider is provided with one or more collars 20 which extend through the divider near the upper surface. Each of the collars are provided with hooks 12 and loops 14 which surround the outer and/or inner surfaces of the collars on opposite sides of the divider. The hooks or loops mate with loops or hooks on a connecting end of a blower duct and on one end of a flow duct which is secured to the collars by mating loops or hooks. The connecting end of the blower duct and flow duct has either hooks or loops on the outer or inner surface which matches loops or hooks on the outer or inner surface of the collars. It will be obvious to one skilled in the art that hooks on one of the surfaces match or cooperate with loops on the opposite surface or vice versa.

Figure 2:
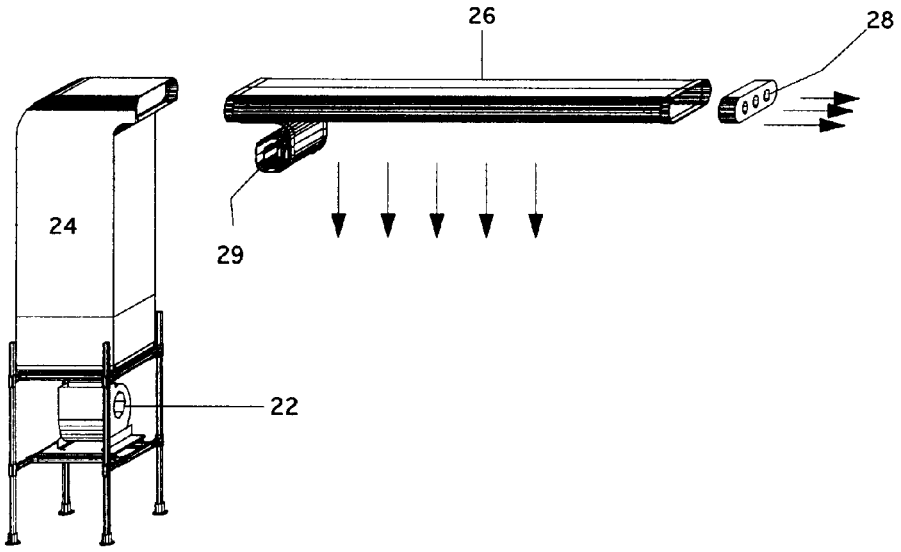
FIG. 2 illustrates a positive pressure system shown without a room or room divider.
Figure 3:
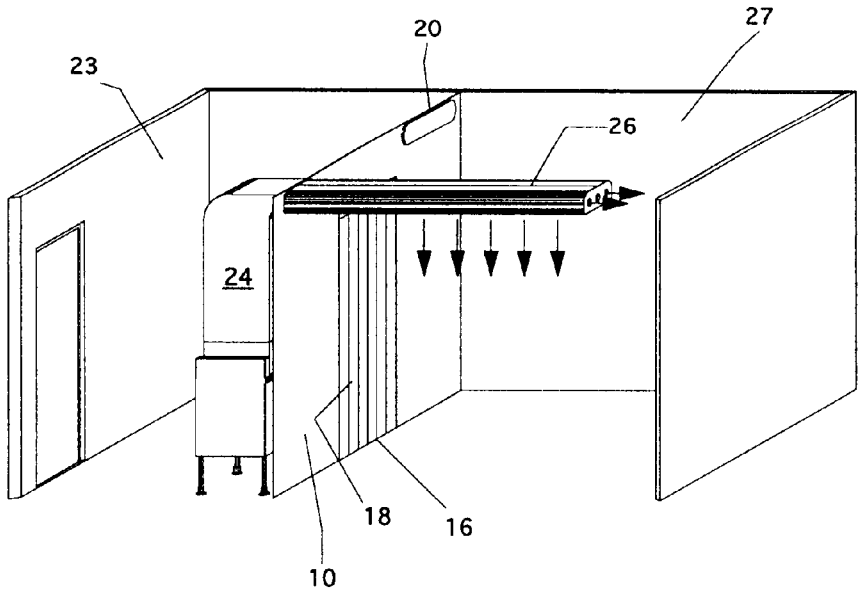
FIG. 3 illustrates a positive pressure system illustrating a positive pressure space divided from a space at atmospheric pressure or one at a lesser positive pressure space with one air blower and one duct.

FIGS. 2 and 3 illustrate a blower 22 with a HEPA filter, not shown, in an area or room 23 and which directs clean air via a duct 24 that is connected to one end of the collar 20 on the blower side of the divider 10. The air is blown through the collar into an air flow duct 26 on the opposite side of the divider. The air flow duct has one end connected to the collar on the clean air positive pressure side of the divider in the clean room 27. The duct 26 is provided with spaced apertures, not shown, in its bottom surface through which air is directed downwardly into the room 27 as shown by the arrows in FIGS. 2, 3, and 4. The end of the flow duct 26 connected to the collar is provided with loops or hooks that mate with hooks or loops on the collar. As shown in FIGS.

3 and 4, the end of the flow duct 26 is connected to the outside surface of the collar. The end of the duct not connected to the collar can be closed off by an end cap, not shown, or provided with apertures 28 as shown through which air can flow.

As shown in FIG. 2, the flow duct 26 is provided with a rolled sheet of vinyl 29 or any other desired material which closes off the apertures in the duct 28 when the rolled sheet is rolled along the bottom surface of the duct 26. The rolled sheet is not shown in FIGS. 3 and 4 for simplification of the drawings. The purpose of the rolled sheet will be explained in the description of FIGS. 5–7.

Figure 4:
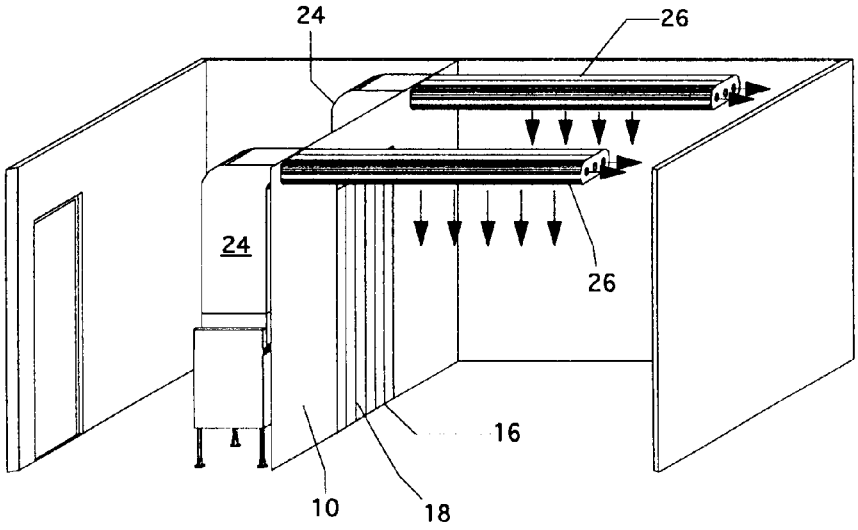
FIG. 4 illustrates a positive pressure system with two ducts and two blowers.

FIG. 3 illustrates a clean air source using one blower duct system. FIG. 4 illustrates two blower duct systems which can be used for air exchange on larger rooms than is compatible with one blower. The collar not used in the system of FIG. 3 can be closed off by an end piece which prevents air from leaving the room.

As shown in FIGS. 3, 4, 6 and 7, a side wall which would complete the room enclosure is not shown, has been omitted so that the air-blower system parts can be seen. The room enclosure would also have an upper (ceiling) wall as well as the omitted side wall, neither of which is shown. As shown in FIGS. 3 and 4, the room 23 which includes the blower is normally a negative pressure space 30 and the room 27 including the flow duct 26 is normally a positive pressure space.

Figure 5:
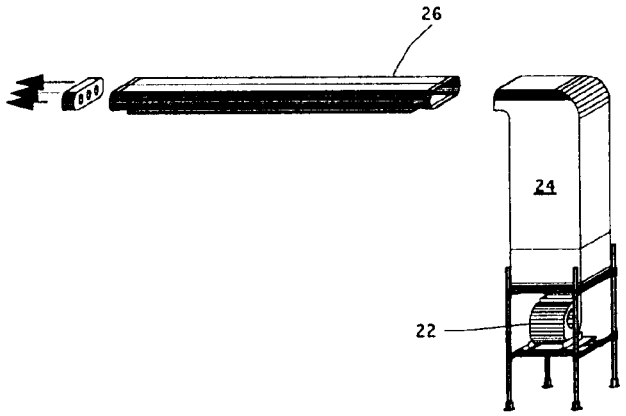
FIG. 5 illustrates a negative pressure system shown without a negative and positive pressure space.
Figure 6:
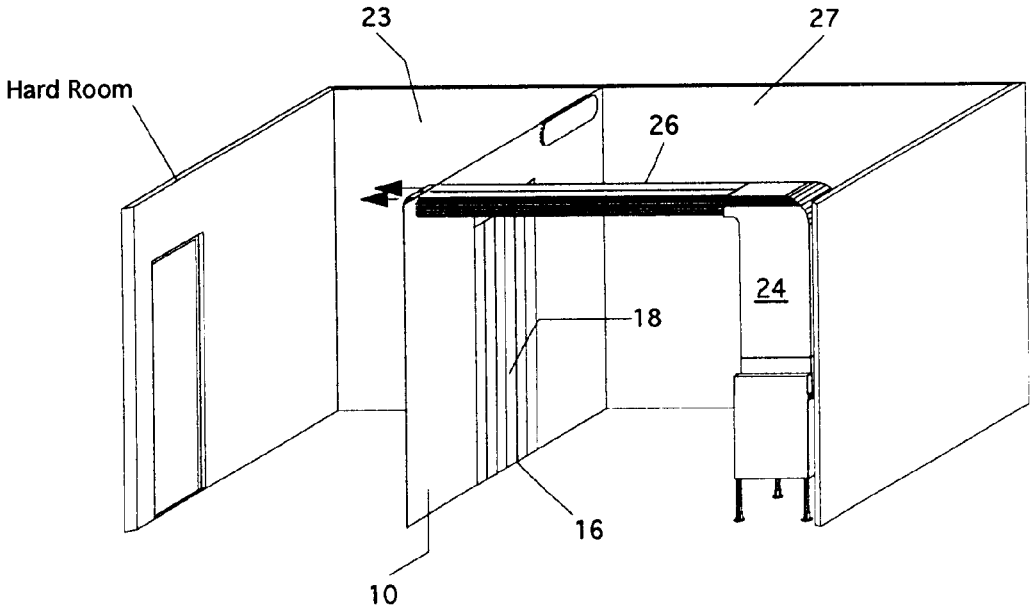
FIG. 6 illustrates a negative pressure system with a negative pressure space and a positive pressure space using one blower and one duct.
Figure 7:
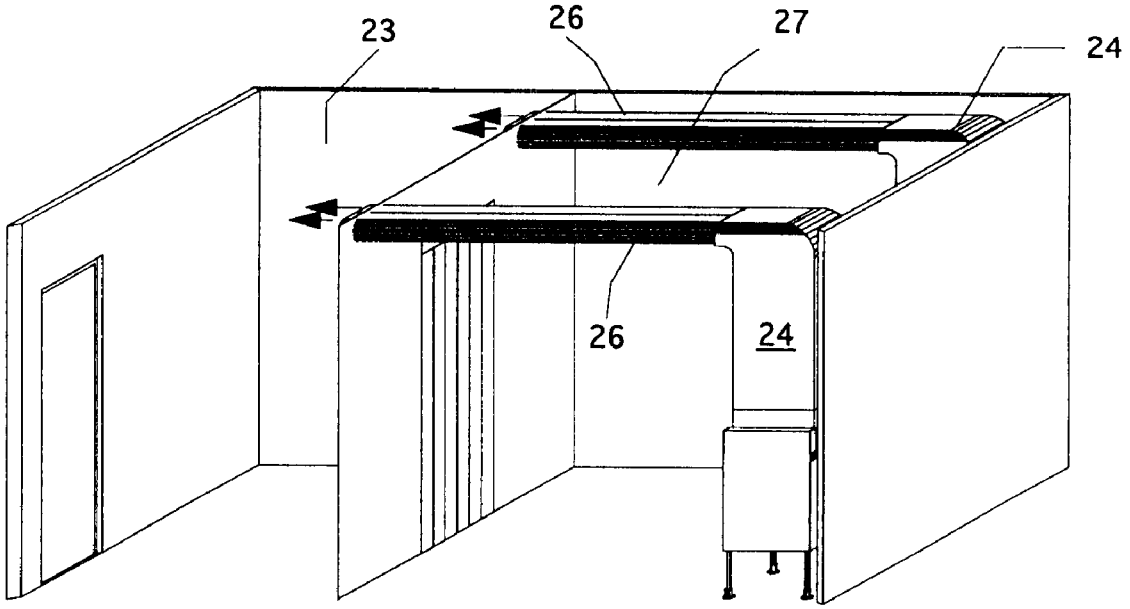
FIG. 7 illustrates a negative pressure system using two blowers and two ducts.
Figure 8:
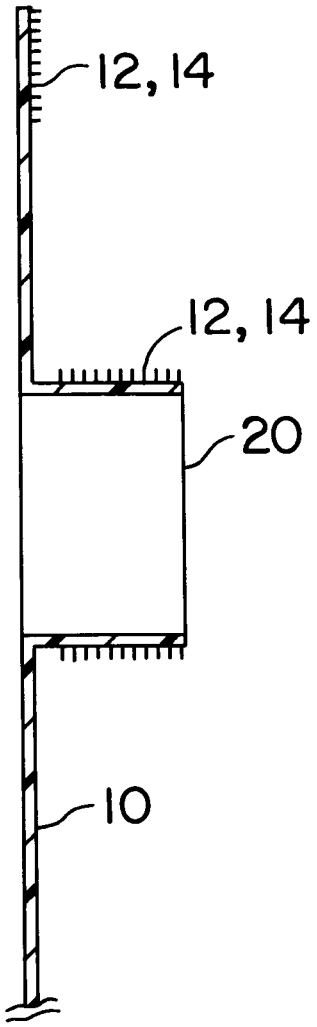
FIG. 8 is a fragmentary sectional view through the collar shown in FIG. 1.

In the systems shown in FIGS. 2–4, specimens used for research are in the positive pressure room 27. There are instances when the positive pressure room should be changed to a negative pressure room. This is one of the features of the invention. FIGS. 5–7 illustrate a pressure system in which the positive pressure room is changed to a negative pressure room.

If the occasion arises that the positive pressure space is to be changed to a negative pressure space the blower and the blower duct will be moved from the room 23 to the room 27 in which the specimens are located. After moving the blower and blower duct the outlet end of the flow duct 26 is connected to the outlet end of the blower duct so that now the outlet end of the flow duct 26 becomes the inlet end of the duct. The previous inlet end of the duct remains connected to the collar 20 and now becomes the outlet end of the negative pressure flow duct. The opposite end of the collar extending into the now positive pressure space becomes the outlet for the negative pressure space.

As shown in FIGS. 5–7, the same equipment used for the positive pressure space is used for changing the positive pressure space into a negative pressure space. The change requires moving the blower 22, and the blower duct 24, into the specimen room and connecting the blower duct outlet end to the previous outlet end of the flow duct, which now becomes the air inlet end. The flow duct end connected to the collar remains connected thereto. Therefore the only requirement to change the positive pressure space to a negative pressure space is to disconnect the outlet end of the blower duct from the end of the collar in the room adjacent to the specimen room and to move the blower 22 and blower duct 24 to the specimen room and to connect the outlet end of the blower duct to the previously noted outlet end of the flow duct. The previously noted outlet end of the flow duct now becomes the inlet to the flow duct. The opposite end of the flow duct remains connected to the collar so there is no change in the flow duct connection with the collar.

In changing the flow duct 26 from a positive pressure flow to a negative pressure flow, the outlet apertures in the lower surface along the length of the flow duct are covered by the rolled sheet 29 secured at the inlet end of the positive pressure flow duct. The rolled sheet and lower surface of the flow duct are provided with matching loops and hooks, such as VELCRO®. The rolled sheet is unrolled and secured to the lower surface of the flow duct in order to prevent the air flow from being blown back into the room. Thus, the positive pressure room 27 can be easily and quickly changed to a negative pressure space. A quick change may be necessary to prevent contamination of the specimens in the specimen room from escaping into adjacent areas.

In order to insure a smooth air flow between the connection of the blower duct with the collar for positive pressure or the end of the flow duct for negative pressure, the end of the blower duct should fit into the connecting end of the collar or the end of the flow duct. The end of the flow duct can be connected to the outside surface of the collar for positive pressure and for negative pressure; therefore, the connection could be used for both positive and negative pressure. If one skilled in the art feels it is necessary, the end of the flow duct can fit into the end of the collar. However this requires an additional change in moving from a positive pressure space to a negative pressure space.

It is believed apparent that more than one divider wall 10 may be provided to divide the room 27 into two or more smaller rooms. In such a case at least one duct 26 would extend through each divider wall so that at least one duct 26 would terminate in each sub-room. If only one sub-room is then to be converted to a negative pressure room, a blower 22 and duct 24 would be moved into that sub-room and connected to the open end of that duct. The cover sheets would then be attached or removed from the ducts in the respective sub-room as required to provide the desired air flow and room isolation.

The description has been set forth for a change from a positive pressure space to a negative pressure space; however the change could be reversed from a negative pressure space to a positive pressure space. Such a change would require a reversal of the procedure as described above.

The foregoing relates to preferred exemplary embodiments of the invention, it being understood that other variants and embodiments thereof are possible within the spirit and scope of the invention, the latter being defined by the appended claims.

I claim:

1. A system for selectively creating a positive or negative pressure in a selected portion of the space of a room which comprises, at least one moveable room divider (10) in said room dividing the room into at least one first space and at least one second space, at least one opening in each said at least one room divider, a collar (20) in each said at least one opening, said collar extending from said at least one first space to said at least one second space, a flow duct (26) being connected to an end of each said collar (20) extending into said at least one second space, at least one air flow aperture, in a bottom surface of the flow duct, cover means (29) for closing said at least one air flow aperture, said cover means including means for releasably securing said cover means to a bottom surface of said flow duct (26) to cover and close said at least one air flow aperture therein a blower (22), and a blower duct (24) connected with an output end of said blower and to an end of said collar in said first space or with one end of said flow duct in said at least one second space.

2. A system as defined in claim 1, wherein, said blower and blower duct are located in said at least one first space and connected with one end of said collar for creating a positive pressure in said at least one second space.

3. A system as defined in claim 2, wherein said blower and blower duct are located in said at least one second space and connected to an end of said flow duct in said second space to produce a negative pressure in said second space.

4. A system as defined in claim 1, wherein, said blower, and blower duct are located in said first space and connected with one end of said collar for creating a positive pressure in said second space.

5. A system as defined in claim 1, wherein said cover means comprises an elongated cover strip which may be extended along and be secured to a bottom surface of said flow duct to close said at least one air flow aperture.

6. A system as defined in claim 1, further comprising means releasibly securing the top and sides of each said room divider to ceiling and wall surfaces, respectively, of the room.

7. A system as defined in claim 2, wherein, said at least one room divider is made of vinyl, and said at least one room divider includes loops or hooks along a top surface and side surfaces which are connected to loops or hooks on corresponding inner surfaces of the room.

8. A system as defined in claim 4, wherein, said at least one room divider is made of vinyl, and said at least one room divider includes loops or hooks along a top surface and side surfaces which are connected to loops or hooks on corresponding inner surfaces of the room.

9. A system as defined in claim 1, wherein, said cover means closes the at least one air flow aperture in the flow duct during operation in a negative pressure mode.

10. A system as defined in claim 4, wherein, said cover means closes the at least one air flow aperture in the flow duct during operation in a negative pressure mode.

11. A system as defined in claim 5, wherein, said cover means closes the at least one air flow aperture in the flow duct during operation in a negative pressure mode.

12. A system as defined in claim 8, wherein, said cover means closes the at least one aperture in the flow duct during operation in a negative pressure mode.

13. A system as defined in claim 1, wherein, said collar includes loops or hooks on an outer surface surrounding each end of said collar, an outlet end of said blower duct includes loops or hooks which mate with loops or hooks on said collar, and one end of said flow duct includes loops or hooks which mate with loops or hooks on one end of said collar extending into the second space.

14. A system as defined in claim 2, wherein, said collar includes loops or hooks on an outer surface surrounding each end of said collar, an outlet end of said blower duct includes loops or hooks which mate with loops or hooks on said collar, and one end of said flow duct includes loops or hooks which mate with loops or hooks on one end of said collar extending into the second space.

15. A system as set forth in claim 4, wherein, an end of said flow duct to which an outlet end of said blower duct is connected is provided with loops or hooks that mate with loops or hooks on the connecting end of the blower duct.

16. A system as set forth in claim 5, wherein, an end of said flow duct to which an outlet end of said blower duct is connected is provided with loops or hooks that mate with loops or hooks on the connecting end of the blower duct.

17. A system as set forth in claim 9, wherein, an end of said flow duct to which an outlet end of said blower duct is connected is provided with loops or hooks that mate with loops or hooks on the connecting end of the blower duct.

18. A system as defined in claims 6, wherein said at least one room divider is made of vinyl, and wherein said means releasibly securing the top and sides of each moveable room divider to ceiling and wall surfaces of the room includes loops or hooks along a top surface and side surfaces of each said room divider which are connected to loops or hooks on corresponding inner surfaces of the room.

* * * * *